US011408285B2

(12) United States Patent
Kennedy et al.

(10) Patent No.: US 11,408,285 B2
(45) Date of Patent: Aug. 9, 2022

(54) JACK FOR INSTALLING MINE STOPPING

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 12 days.

(21) Appl. No.: 16/732,079

(22) Filed: Dec. 31, 2019

(65) Prior Publication Data

US 2021/0199008 A1 Jul. 1, 2021

(51) Int. Cl.
*B66F 3/00* (2006.01)
*E21F 17/103* (2006.01)

(52) U.S. Cl.
CPC ..... *E21F 17/103* (2013.01); *B66F 3/005* (2013.01)

(58) Field of Classification Search
CPC ..... E21F 17/103; B66F 3/005
USPC ..... 254/116
See application file for complete search history.

(56) References Cited

U.S. PATENT DOCUMENTS 1,158,192 A * 10/1915 Ette ..... B66F 1/06 254/118
2,729,064 A 1/1956 Kennedy et al.
3,090,600 A * 5/1963 Smith ..... B60P 7/15 410/151
4,483,642 A 11/1984 Kennedy et al.
4,695,035 A 9/1987 Kennedy et al.
7,374,380 B2 * 5/2008 Huang ..... E04G 25/08 410/151
7,438,506 B2 10/2008 Kennedy et al.

* cited by examiner

*Primary Examiner* — Lee D Wilson
(74) *Attorney, Agent, or Firm* — Stinson LLP

(57) ABSTRACT

A jack for installing a mine stopping panel includes an extendible post and a press for extending the extendible post. The press can have a lever movable between an actuated position and a non-actuated position and operative to extend the post as it moves toward the actuated position and retract the post as it moves toward the non-actuated position. A yieldable biaser yields when the post is extended to extend the mine stopping panel and the mine stopping panel engages a mine surface with sufficient force to crush a stopping seal and anchor the stopping panel. The press can comprise an over-center toggle linkage.

22 Claims, 16 Drawing Sheets

JACK FOR INSTALLING MINE STOPPING

FIELD

The present disclosure generally relates to a jack for installing a mine stopping.

BACKGROUND

Mine stoppings can be installed in the passageway of a mine to block the flow of air through the passageway. As described in, for example, U.S. Pat. Nos. 2,729,064, 4,483,642, 4,695,035, and 7,438,506, each of which is hereby expressly incorporated by reference in its entirety, mine stoppings comprise a plurality of extendible mine stopping panels arranged in side-by-side relation across a mine passageway. To seal the passageway, each of the panels is extended longitudinally until a seal member at one end of the panel is crushed against a wall of the passageway. After extending the panels, a panel securing system (e.g., a system of clamps as described in U.S. Pat. No. 7,438,506, a system of ties as described in U.S. Pat. No. 4,483,642, or a system of brackets as described in U.S. Pat. No. 2,729,064) is installed to yieldably hold the panels in the extended positions while allowing the panels to contract in the event of mine convergence.

Various jacks have been used to extend the extendible panel of a mine stopping. For example, U.S. Pat. No. 4,483,642 describes a ratcheting jack that telescopically extends the jack to extend an upper telescoping panel member with respect to a lower panel member. The ratcheting jack incrementally extends the panel with each throw of the jack lever. U.S. Pat. No. 4,695,035 describes a bottle jack that uses a lever-actuated pressurized cylinder to telescopically extend the jack. The bottle jack likewise incrementally extends the panel with each throw of the lever. U.S. Pat. No. 7,438,506 describes a jack comprising a gripping system that causes a lever actuator to grip an extendible shaft when the lever is pivoted in a first direction and release the extendible shaft when the lever is pivoted in an opposite direction. Thus, the gripping system is operative to incrementally extend the jack, and thereby incrementally extend the panel, with each throw of the lever.

SUMMARY

In one aspect, a jack for installing a mine stopping panel in a mine passageway comprises a first stopping panel support configured to engage a first portion of the mine stopping panel to press the first portion against a first surface of the mine passageway. The jack includes a second stopping panel support configured to engage a second portion of the mine stopping panel to move the second portion away from the first portion to press the second portion against a second surface of the mine passageway. An extendible post has a length and comprises a first post segment connected to the first stopping panel support and second post segment connected to the second stopping panel support. The first post segment is movable relative to the second post segment to adjust the length of the extendible post. The jack includes a press configured to move the first post segment relative to the second post segment such that the first stopping panel support moves away from the second stopping panel support to press the first portion of the mine stopping panel against the first surface of the mine passageway. The press includes a lever movable relative to the extendible post to a non-actuated position and to an actuated position. The press is connected to the first and second post segments such that movement of the lever toward the actuated position moves the first post segment relative to the second post segment to extend the length of the extendible post and movement of the lever toward the non-actuated position moves the first post segment relative to the second post segment to retract the length of the extendible post.

In another aspect, a jack for installing a mine stopping panel in a mine passageway comprises a column including a first stopping panel support, a second stopping panel support, an extendible post, and a press. The first stopping panel support is configured to engage a first portion of the mine stopping panel to press the first portion of the mine stopping panel against a first surface of the mine passageway. The second stopping panel support is configured to move a second portion of the mine stopping panel away from the first portion to press the second portion of the mine stopping panel against a second surface of the mine passageway. The extendible post has a length and comprises a first post segment connected to the first stopping panel support and a second post segment connected to the second stopping panel support. The first post segment is movable relative to the second post segment to adjust the length of the extendible post. The press is connected to the first and second post segments and configured to move the first post segment relative to the second post segment such that the first stopping panel support moves away from the second stopping panel support to press the first portion of the mine stopping panel against the first surface of the mine passageway. The column is configured to yield in response to a compression force on the extendible post resulting from the first stopping panel support pressing the first portion of the mine stopping panel against the first surface of the mine passageway. The column is configured to bias the first stopping panel support away from the second stopping panel support after yielding in response to the compression force.

In another aspect, a jack for installing a mine stopping panel in a mine passageway comprises a first stopping panel support configured to engage a first portion of the mine stopping panel to press the first portion of the mine stopping panel against a first surface of the mine passageway. A second stopping panel support is configured to press a second portion of the mine stopping panel away from the first portion to press the second portion of the mine stopping panel against a second surface of the mine passageway. An extendible post has a length and comprises a first post segment connected to the first stopping panel support and second post segment connected to the second stopping panel support. The first post segment is movable relative to the second post segment to adjust the length of the extendible post. A press comprises a connecting linkage. The connecting linkage includes a first link and a second link. The first link is configured to be connected to the first post segment for rotation with respect to the first post segment about a first pivot axis. The second link is connected to the second post segment for rotation with respect to the second post segment about a second pivot axis. The first link is connected to the second link for rotation with respect to the second link about a connecting pivot axis. The connecting linkage is movable through a range of motion from a first configuration to a second configuration, and the press is configured to extend the length of the extendible post as the connecting linkage moves in the range of motion from the first configuration toward the second configuration. At least one retainer connected to the first link is configured to connect the first link to the first post segment. The first post segment has a first post segment length and a plurality of retainer receivers spaced from each other along the first post segment length. Each retainer receiver is configured to receive the retainer to connect the first link and the first post segment.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
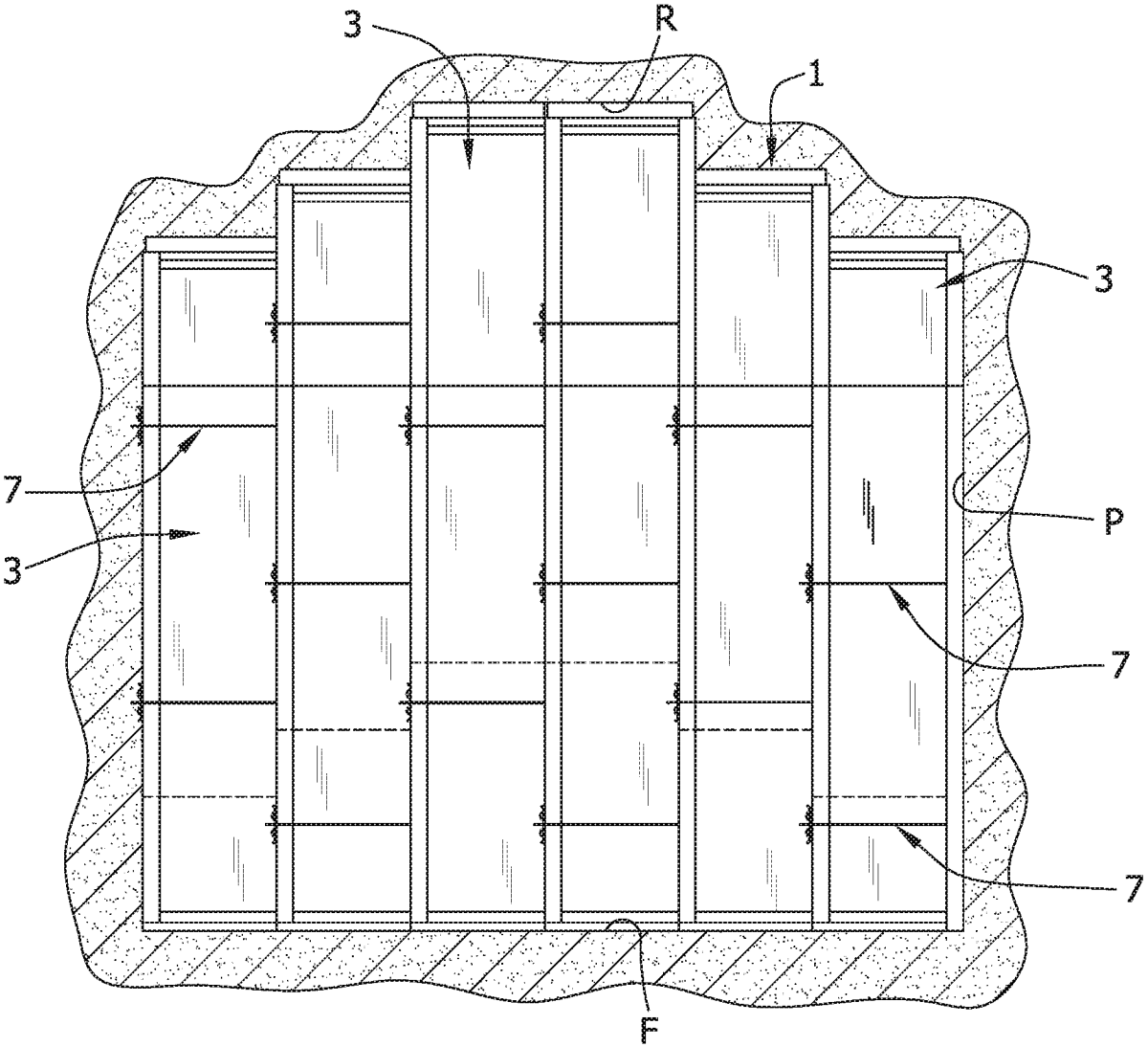
FIG. 1 is a front elevation of a mine stopping including a plurality of mine stopping panels installed using a panel system of the present invention.

Referring to FIG. 1, an exemplary embodiment of a mine stopping is generally designated by the reference number 1. The mine stopping 1 is shown installed in the passageway P of a mine such that the mine stopping blocks the flow of air through the passageway. The mine stopping 1 comprises a plurality of elongate, longitudinally extendible mine stopping panels 3. In FIG. 1, the panels 3 extend vertically in side-by-side relation from the floor F to the roof R of a mine passageway. It is contemplated that the panels could have other orientations or arrangements in other embodiments. As described in detail in U.S. Pat. No. 7,438,506, a panel securing system comprising a plurality of clamping devices, each generally designated 7, is provided to secure the illustrated panels 3 relative to one another in their extended configurations. In other embodiments, other types of panel securing systems (e.g., systems using ties or brackets) can be used without departing from the scope of the present disclosure.

Figure 2:
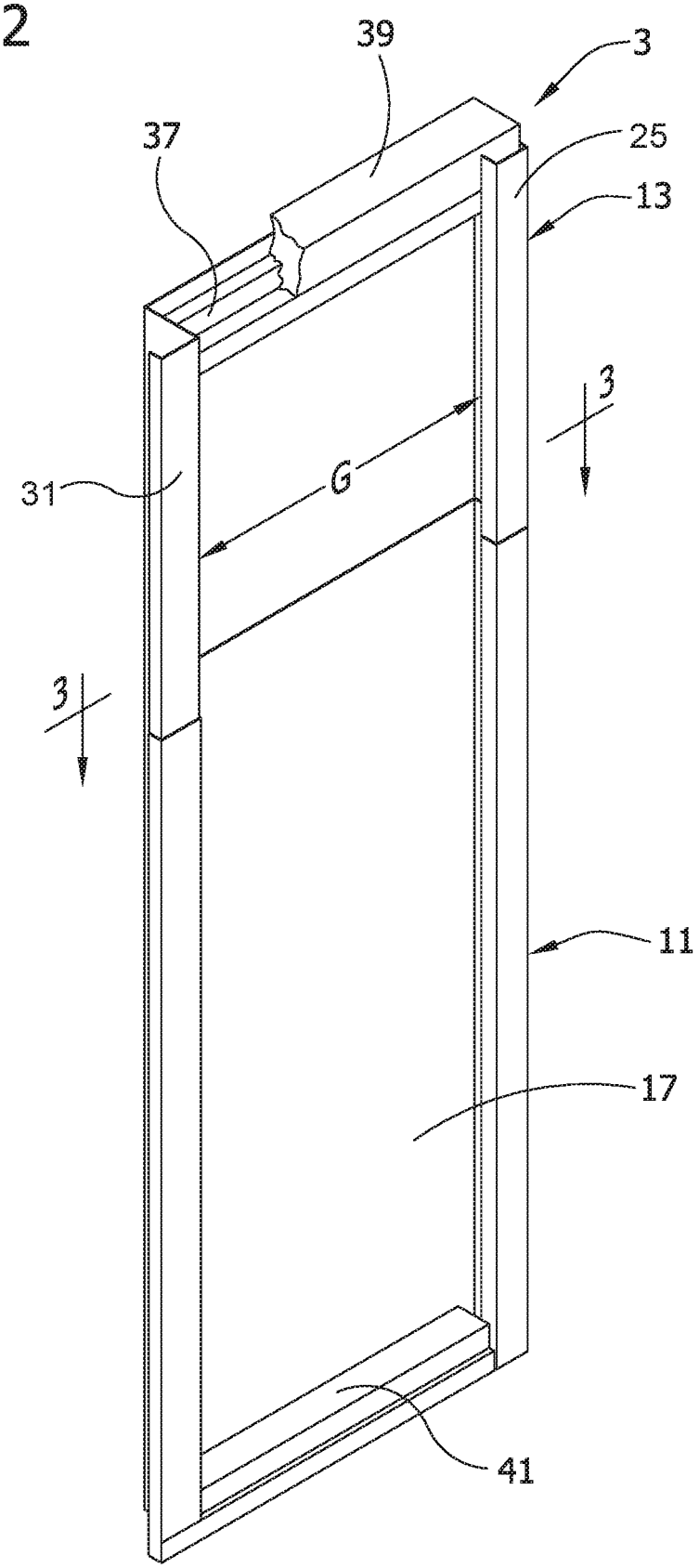
FIG. 2 is a perspective of an extendible panel of the system.
Figure 3:
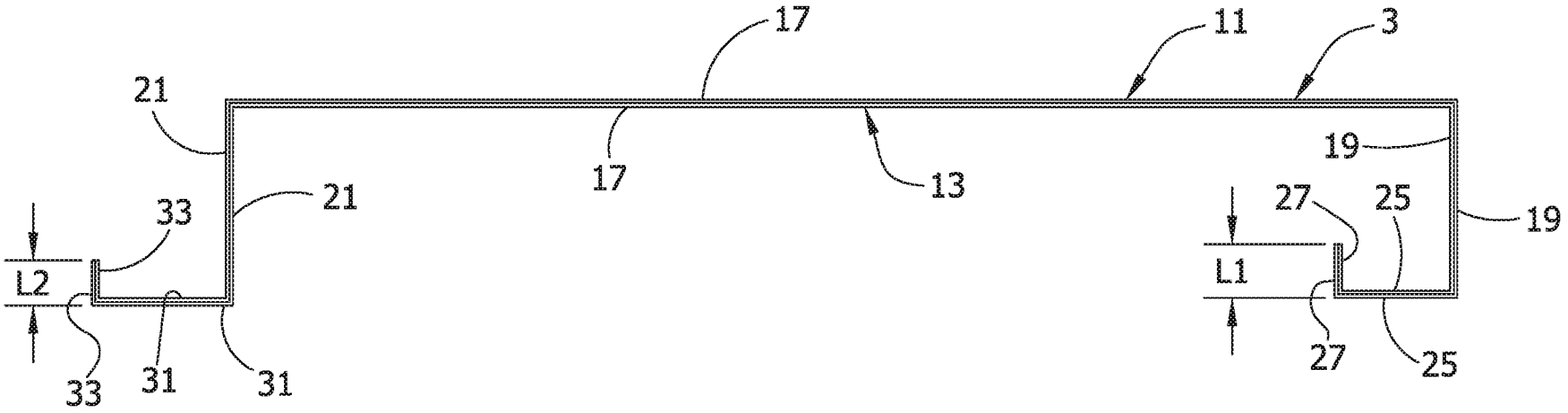
FIG. 3 is an enlarged cross section on 3-3 of FIG. 2.

Referring to FIGS. 2 and 3, each of the illustrated panels 3 of the mine stopping 1 includes first and second panel members 11, 13. In the illustrated embodiment, the first panel member 11 is a lower panel member configured for engagement of its lower end with the floor F of the passageway P, as shown in FIG. 1, and the second panel member 13 is an upper panel member configured for engagement of its upper end with the roof R of the passageway. In one or more embodiments, each panel member 11, 13 is generally of channel shape in cross section, having a web 17 and first and second flanges 19, 21 at opposite sides of the web. As shown in FIG. 3, the first flange 19 has an in-turned portion 25 at its outer edge extending generally toward the second flange 21 and generally parallel to the web 17, and a lip 27 at the inner edge of the in-turned portion extending toward the web. The first flange 19 terminates short of the second flange 21 to form a gap therebetween, indicated at G in FIG. 2. The second flange 21 has an out-turned portion 31 (FIG. 3) at its outer edge extending generally away from the first flange 19 and generally in the same plane as the in-turned portion 25 of the first flange, and a lip 33 at the outer edge of the out-turned portion 31 extending generally in the same direction and generally parallel to the lip 27 of the first flange 19. In one embodiment, the lip 27 of first flange 19 extends closer to the web 17 than the lip 33 of the second flange 21, i.e., the first flange 19 has a transverse dimension or width L1 greater than the transverse dimension or width L2 of the second flange 21 (FIG. 3). The upper panel member 13 has a telescoping fit in the respective lower panel member 11, the webs 17 of the members being in sliding engagement. (This could be reversed—the lower panel member having a sliding fit in the upper panel member.) The panel members 11, 13 could have other cross sectional shapes, such as other channel shapes (e.g., a channel shape including two in-turned portions, rather than one in-turned portion and one out-turned portion). The panel could also be fabricated as a single panel member or more than two panel members. Moreover, the panel members could be installed extending between left and right surfaces of the mine passage rather than between upper and lower surfaces.

As shown in FIG. 2, the upper panel member 13 desirably has an upper end portion in the form of a head 37 at its upper end. The head 37 includes a sealing member 39 adapted for sealing engagement with the roof R of the mine passageway P. The lower panel member 11 desirably has a lower end portion in the form of a foot 41 at its lower end for engagement with the floor of the passageway. For additional detail regarding an exemplary embodiment of a head 37 and foot 41, reference may be made to U.S. Pat. No. 4,483,642, previously incorporated herein by reference.

Figure 4:
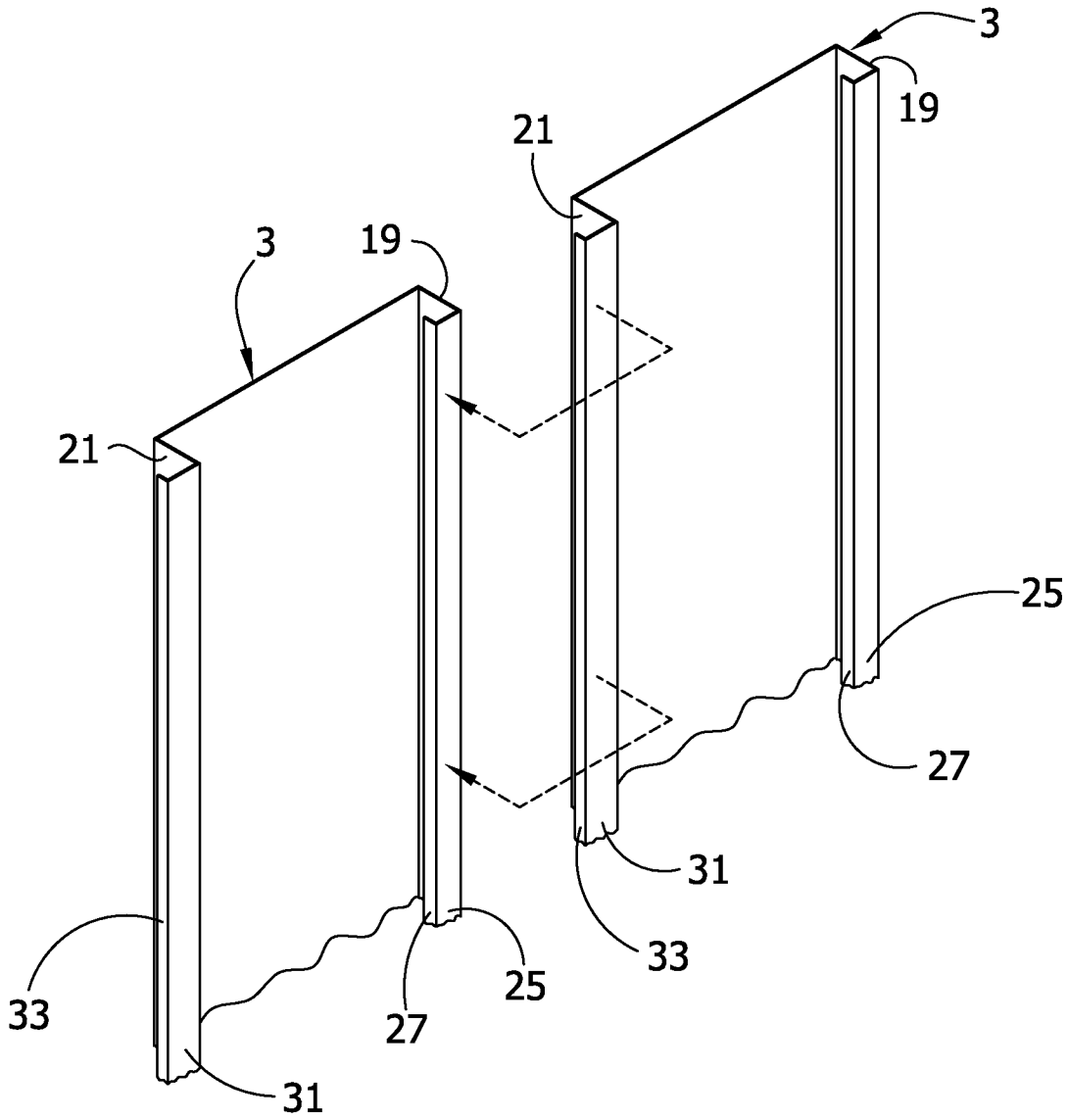
FIG. 4 is an fragmentary view of two extendible panels in side-by-side position.

FIG. 4 shows two panels 3 positioned in side-by-side relation with the side flanges 21 along one side of the first (right) panel generally adjacent the side flanges 19 along an adjacent side of the second (left) panel. As thus positioned, the second (out-turned) flange portions 31 and lips 33 of the upper and lower panel members 11, 13 of the first panel overlap the first (in-turned) flange portions 25 and lips 27 of the upper and lower panel members of the other panel. Any number of panels may be assembled in this way to form the stopping across the mine passageway. In other embodiments, the panels may be constructed to not overlap each other when positioned side-by-side.

Figure 5:
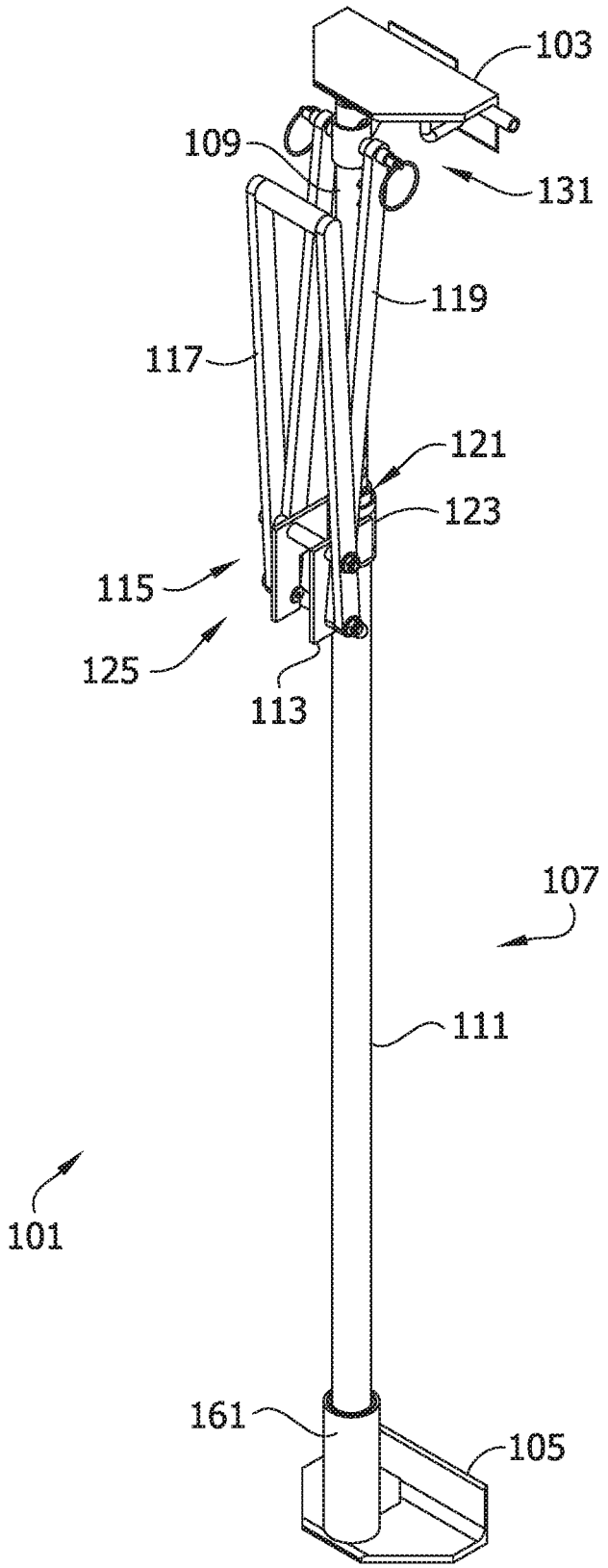
FIG. 5 is a perspective of a jack for extending the extendible panels.
Figure 6:
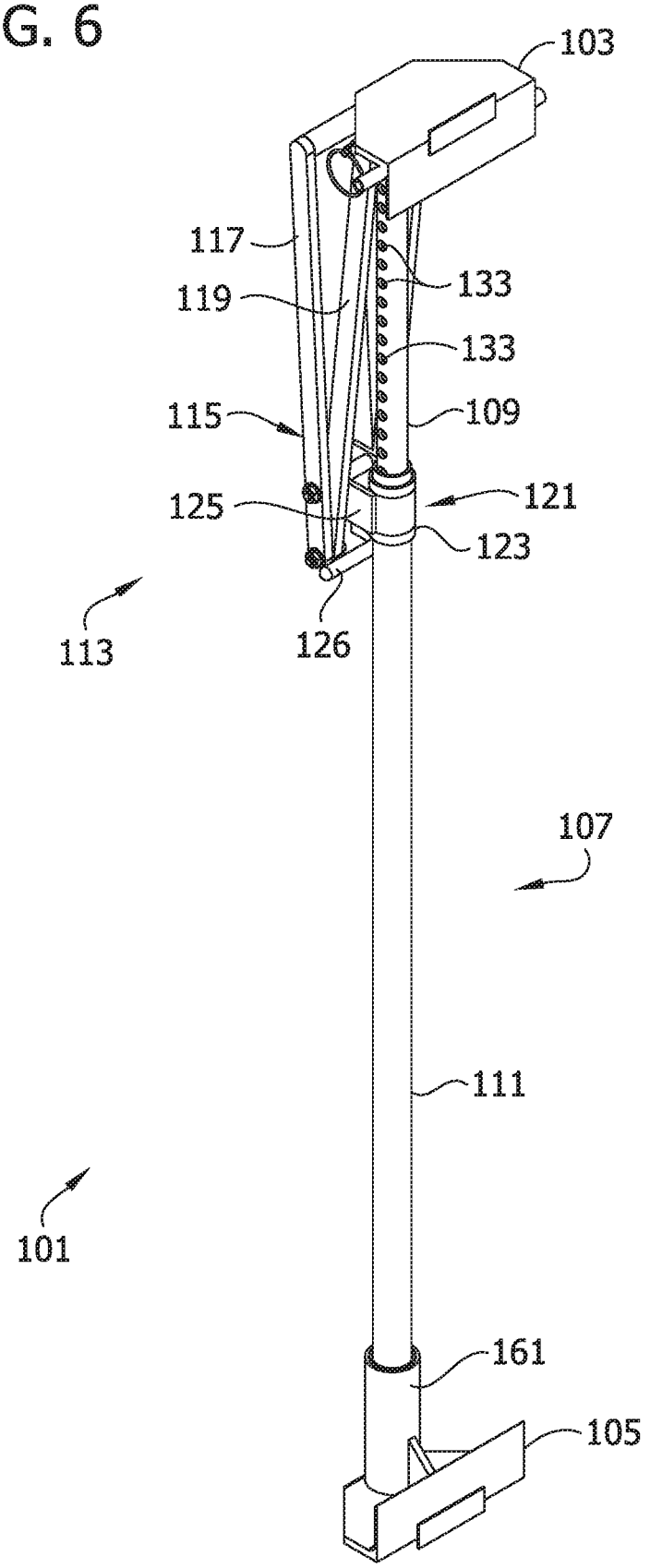
FIG. 6 is another perspective of the jack.
Figure 7:
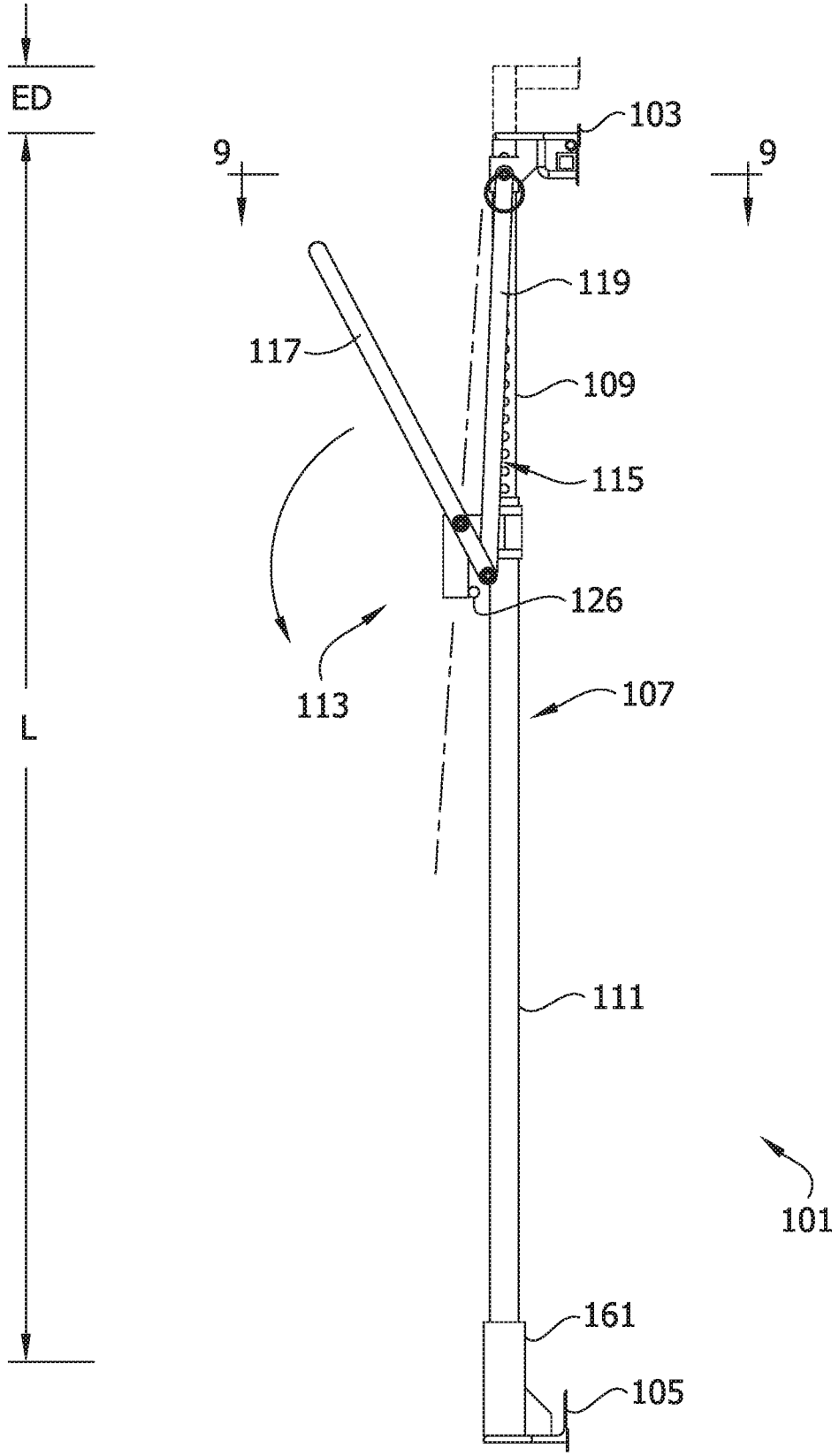
FIG. 7 is an elevation of the jack in a non-actuated position and illustrating the extension of the jack in an actuated position in phantom.

Having described an exemplary embodiment of a mine stopping 1, reference is now made to FIGS. 5-7, in which one embodiment of a jack for extending the panels 3 of the stopping 1 is generally designated at reference number 101. The jack 101 comprises a column (also generally indicated by 101) including a plurality of components such as an upper stopping panel support 103, a lower stopping panel support 105, and an extendible post 107. The upper stopping panel support 103 (broadly, a first stopping panel support) is configured to engage the head 37 (broadly, a first portion) of an extendible stopping panel 3. The lower stopping panel support 105 (broadly, a second stopping panel support) is configured to engage the foot 41 (broadly, a second portion) of the extendible stopping panel. The extendible post 107 has a length L and comprises an upper post segment 109 (broadly, a first post segment) connected to the upper stopping panel support 103 and a lower post segment 111 (broadly, a second post segment) that is connected to the lower stopping panel support 105. The upper post segment 109 is movable relative to the lower post segment 111 to adjust the length L of the post 107 (e.g., extend and retract the post) and thereby adjust a distance between the stopping panel supports 103, 105. In the illustrated embodiment, the upper post segment 109 comprises a cylindrical tube or shaft that is telescopically received in a cylindrical tube of the lower post segment 111 for extending and retracting relative to the lower post segment. The extendible post can have other configurations without departing from the scope of the present disclosure. When the upper stopping panel support 103 is engaged with the head 37 of the stopping panel 3 and the lower stopping panel support 102 is engaged with the foot 41, extension of the post 107 extends the upper panel member 13 from the lower panel member 11 and thereby presses the head and foot against the roof R and floor F of the mine, respectively.

The illustrated jack 101 further comprises a press, generally indicated at 113. The press is configured for adjusting the length L of the extendible post 107. As will be described in further detail below, the illustrated press 113 is configured to be selectively actuated to extend the length of the post 107 by an extension distance ED. In one or more embodiments, the press 113 comprises a linkage, generally indicated at 115, connected to the upper and lower post segments 109, 111. The linkage 115 is movable to selectively extend and retract the upper post segment 109 relative to the lower post segment 111, as will be described in further detail below.

The illustrated linkage 115 comprises a lever 117 (broadly, a first link) pivotally connected to the lower post segment 111 and a connecting link 119 (broadly, a second link) pivotally connected to the lever and upper post segment 109. FIG. 7 uses solid lines to show the configuration of the jack 101 when the lever 117 is in a non-actuated position. As indicated by a curved arrow, the lever 117 can be pulled downward from the non-actuated position to an actuated position. The orientation of the illustrated lever 117 in the actuated position is schematically indicated by a dashed line below the curved arrow. The extended configuration of the post 107 when the lever 117 is in the actuated position is shown in phantom. As will be explained in further detail below, a single downward stroke of the lever 117 actuates the press 113 (e.g., adjusts the linkage 115) to extend the post 107 by the entire extension distance ED of the press.

The press 113 is configured to be selectively connected to the extendible post 107 at a plurality of spaced apart locations along the length of at least one of the upper and lower post segments 109, 111 to adjust a non-actuated length L of the post independent of actuation of the press. For purposes of this disclosure, the "non-actuated length" of the post 107 refers to the length L of the post when the press is in a non-actuated configuration (e.g., when the lever is in the non-actuated position). In this disclosure, the reference character 'L' designates the length of the post generally, whether the press 113 is actuated, non-actuated, or partially actuated. In the illustrated embodiment, a lower post segment mount 121 comprising a collar 123 and a pivot bracket 125 connects the press 113 to the lower post segment 111 at a fixed location along the length of the lower post segment. Stops 126 against which the lever 117 rest in the actuated position extend from opposite sides of the pivot bracket 125. In one or more embodiments, the collar 123 is fixedly mounted on the top end portion of the lower post segment 111, the pivot bracket 125 is mounted on the collar, and the lever 117 is rotatably connected to the pivot bracket. In contrast, an upper post segment connector 131 is configured to selectively connect the press 113 to the upper post segment 109 at a plurality of spaced apart locations along the length of the upper post segment to adjust the non-actuated length L of the post (e.g., coarse adjustment). Suitably, the press 113 is configured such that the extension distance ED achievable by the press is about the same at any non-actuated length of the post 107 (e.g., when the connector 131 is connected to the upper post segment 109 at any location along the length of the upper post).

Figure 8:
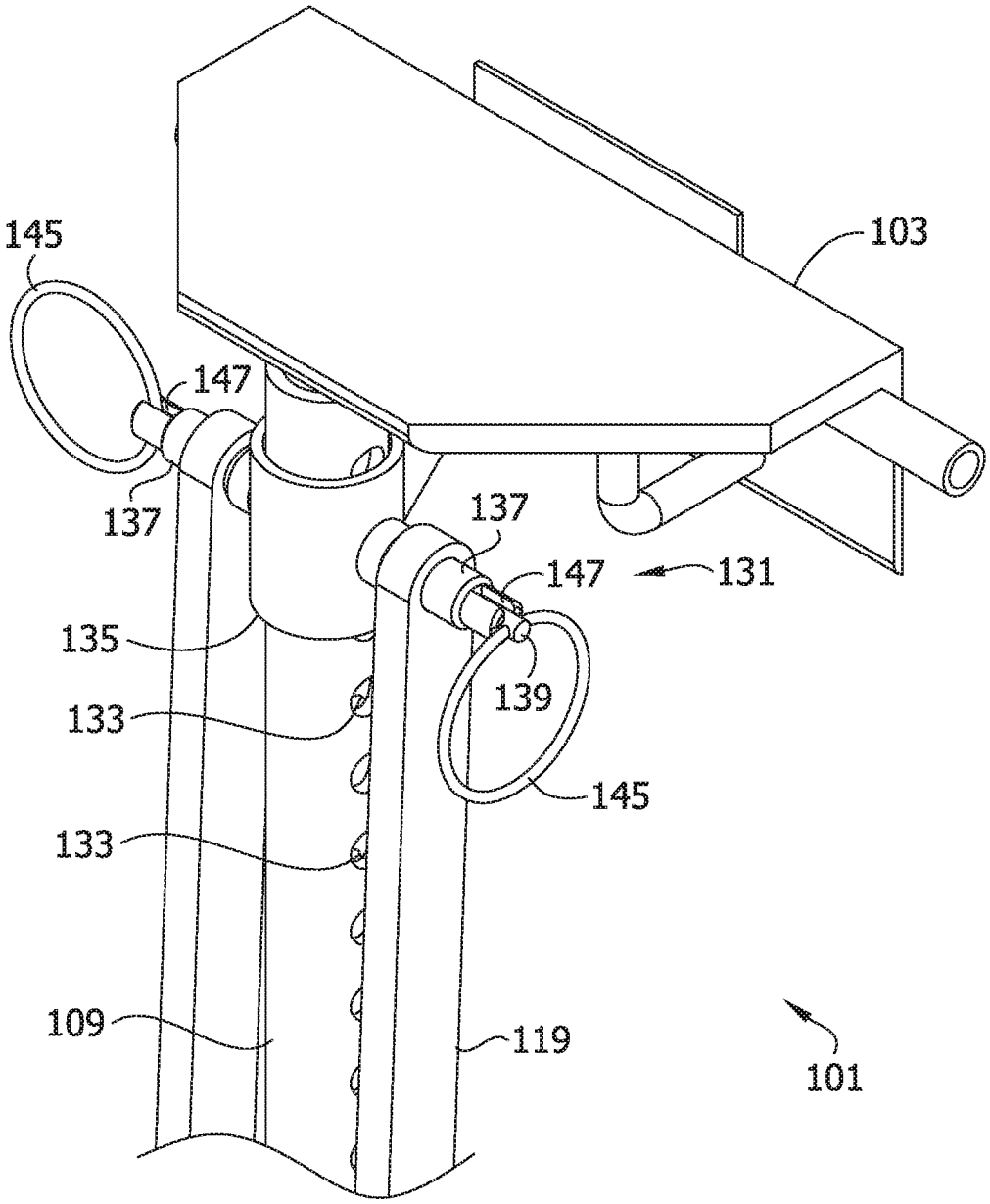
FIG. 8 is an enlarged fragmentary perspective of the jack showing an upper post connector thereof.
Figure 9:
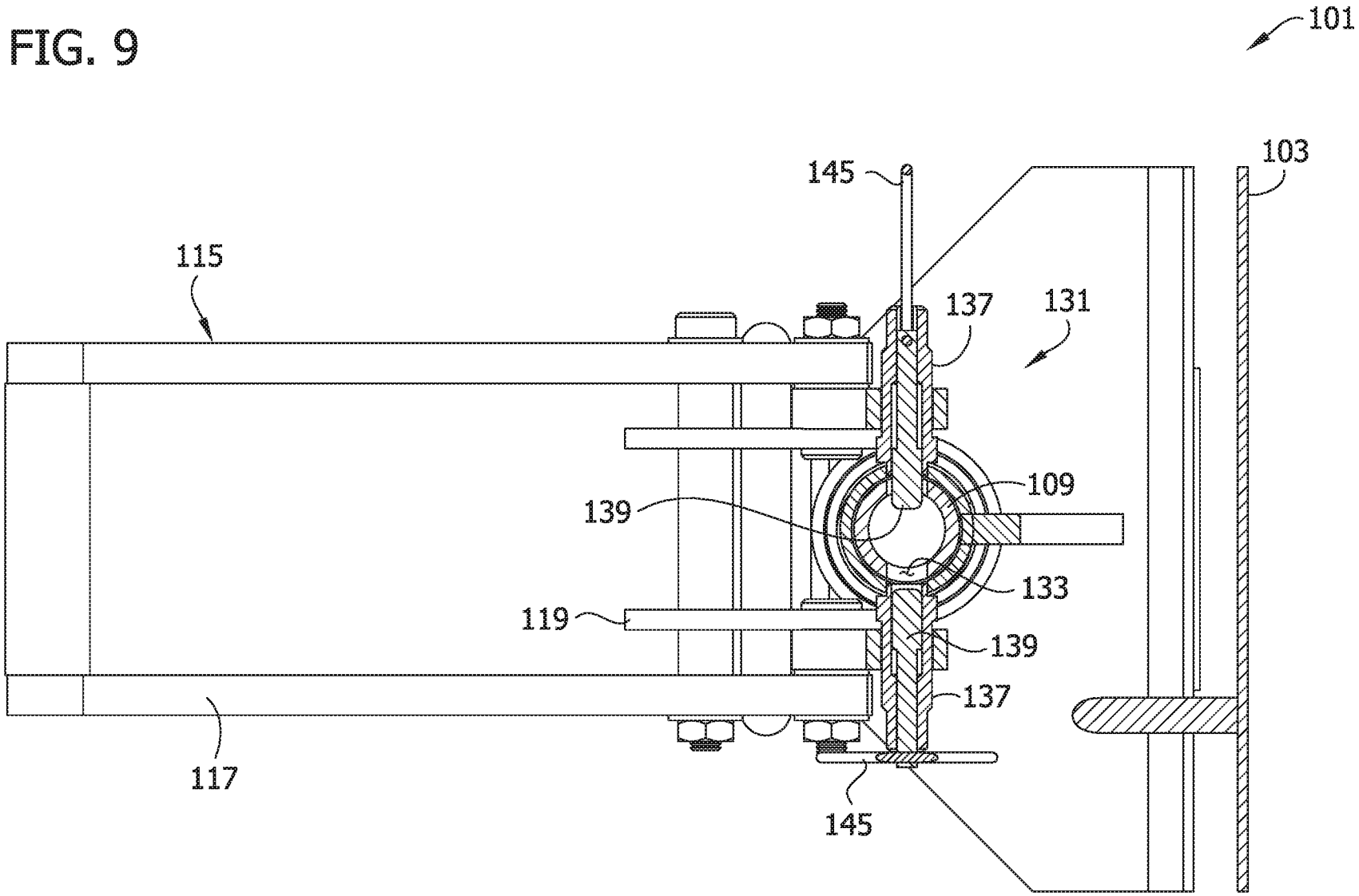
FIG. 9 is a cross-section taken in a plane including line 9-9 of FIG. 7.

Any suitable connector for selectively connecting the press 113 to one of the post segments at spaced apart locations along the length of the post segment can be used without departing from the scope of the present disclosure. In the illustrated embodiment, the upper post segment 109 comprises a plurality of openings 133 (broadly, "retainer receivers") extending diametrically through the shaft member at spaced apart locations along the post segment length. Referring to FIGS. 8 and 9, the illustrated connector 131 includes a collar 135 slidably disposed on the upper post segment 109 for movement along the length of the post segment. A pair of pin guides 137 comprising radially extending tubes are attached to the collar 135 on diametrically opposite sides. Pins 139 (broadly, "protrusions" or "retainers") are slidably received in the pin guides 137 for radial movement with respect to the collar 135 between an inner locked position (pin at left in FIG. 8 and bottom in FIG. 9) and an outer unlocked position (pin at right in FIG. 8 and top in FIG. 9). When the pins 139 are in the inner locked positions, inner end portions of the pins protrude from the collar 135 into respective openings 133 of the upper post segment 109 to connect the press 113 to the upper post segment at a respective location along the length thereof. When the pins 139 are in the outer unlocked positions, the inner end portions of the pins are withdrawn from the openings 133, so that the upper post segment can extend or retract relative to the collar 135 to a position that corresponds with a desired non-actuated length of the post 107.

Referring to FIG. 9, in the illustrated embodiment, a compression spring, which is not shown in the drawing for clarity, can be disposed about each pin 139 in an annular gap between an enlarged inner end portion of the pin and an opposing shoulder of the respective guide 137, to bias the pin toward the locked position. As shown in FIG. 8, in the illustrated embodiment, a ring 145 (broadly, "keeper") is connected to an outer end portion of each pin 139 for keeping or securing the pin in the outer unlocked position against the biasing force of the spring. The ring 145 and the pin 139 are rotatable together about a longitudinal axis of the pin between a non-retaining orientation in which the ring can be received in a slot 147 formed in the outer end portion of the guide 137 (e.g., the left pin in FIG. 8) and a retaining orientation in which the ring engages an end of the guide and is prevented from being received in the slot (e.g., the right pin in FIG. 8). In the retaining orientation, the ring 145 prevents the spring from moving the pin 139 inward to the locked position; but in the non-retaining orientation, the pin is permitted to slide inward to be received in an opening 133 of the upper post segment 109. Accordingly, when the pins 139 are in the inner locked positions, the springs impart biasing forces that inhibit movement of the pins away from the locked positions. And when the pins are in the outer unlocked positions, the rings 145 can be oriented in the retaining orientations to hold the connector 131 in an unlocked configuration while the user slides the upper post segment 109 in the collar 135 to adjust the non-actuated length of the post 107. It will be appreciated that the rings can act as handles permitting a user to move the pins between the locking and non-locking positions and to move the rings between the retaining and non-retaining orientations. Other types of keepers (e.g., other types of handles) can be used without departing from the scope of the present disclosure.

As introduced above, the illustrated press 113 comprises a connecting linkage 115 including the lever 117 and the connecting link 119. In the illustrated embodiment, the connecting linkage 115 comprises a toggle linkage. Each of the lever 117 and the connecting link 119 has a respective length extending between respective opposite first and second end portions. As explained below, the first end portion of the lever 117 includes a free handle, and the first end portion of the connecting link is connected to the upper post connector 131. The second end portions of the lever 117 and the connecting link are pivotally connected to each other.

Figure 10:
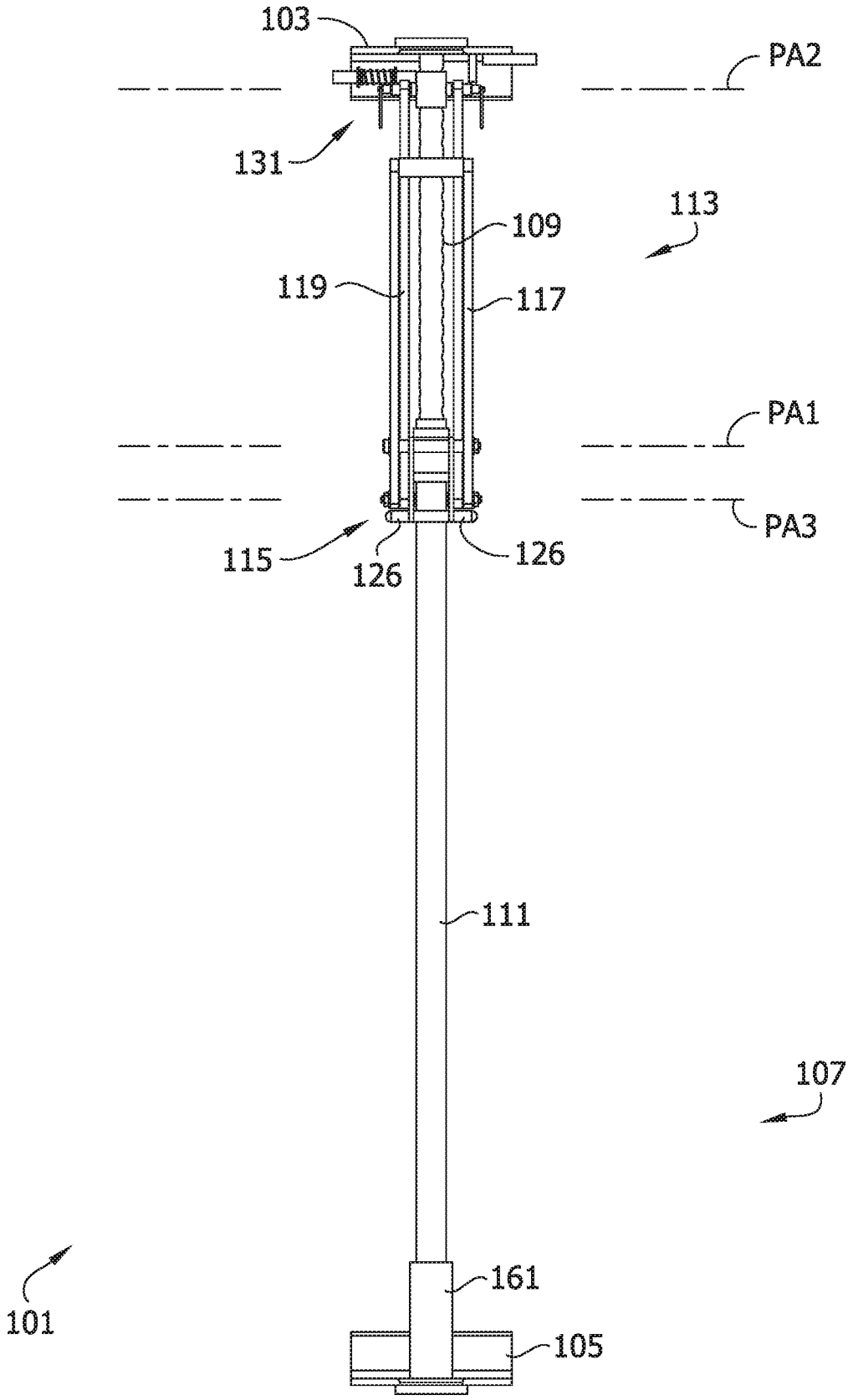
FIG. 10 is another elevation of the jack.

Referring to FIG. 6, the pivot bracket 125 connects the lever 117 to the lower post segment 111 for rotation with respect to the lower post segment about a lever axis PA1 (broadly, a first pivot axis) shown in FIG. 10 that intersects the lever at a fulcrum point that is between and spaced apart along the length of the lever from the first and second end portions. In the illustrated embodiment, the pin guides 137 of the upper post connector 131 connect the connecting link 119 to the upper post segment 109 for rotation with respect to upper post segment 109 about an upper pivot axis PA2 (broadly, a second pivot axis) shown in FIG. 10 that intersects the connecting link at a first end portion of the connecting link. The second end portion of the lever 117 is connected to the second end portion of the connecting link 119 for rotation with respect to the connecting link about a connecting pivot axis PA3 (broadly, a third pivot axis) shown in FIG. 10.

Figure 11A:
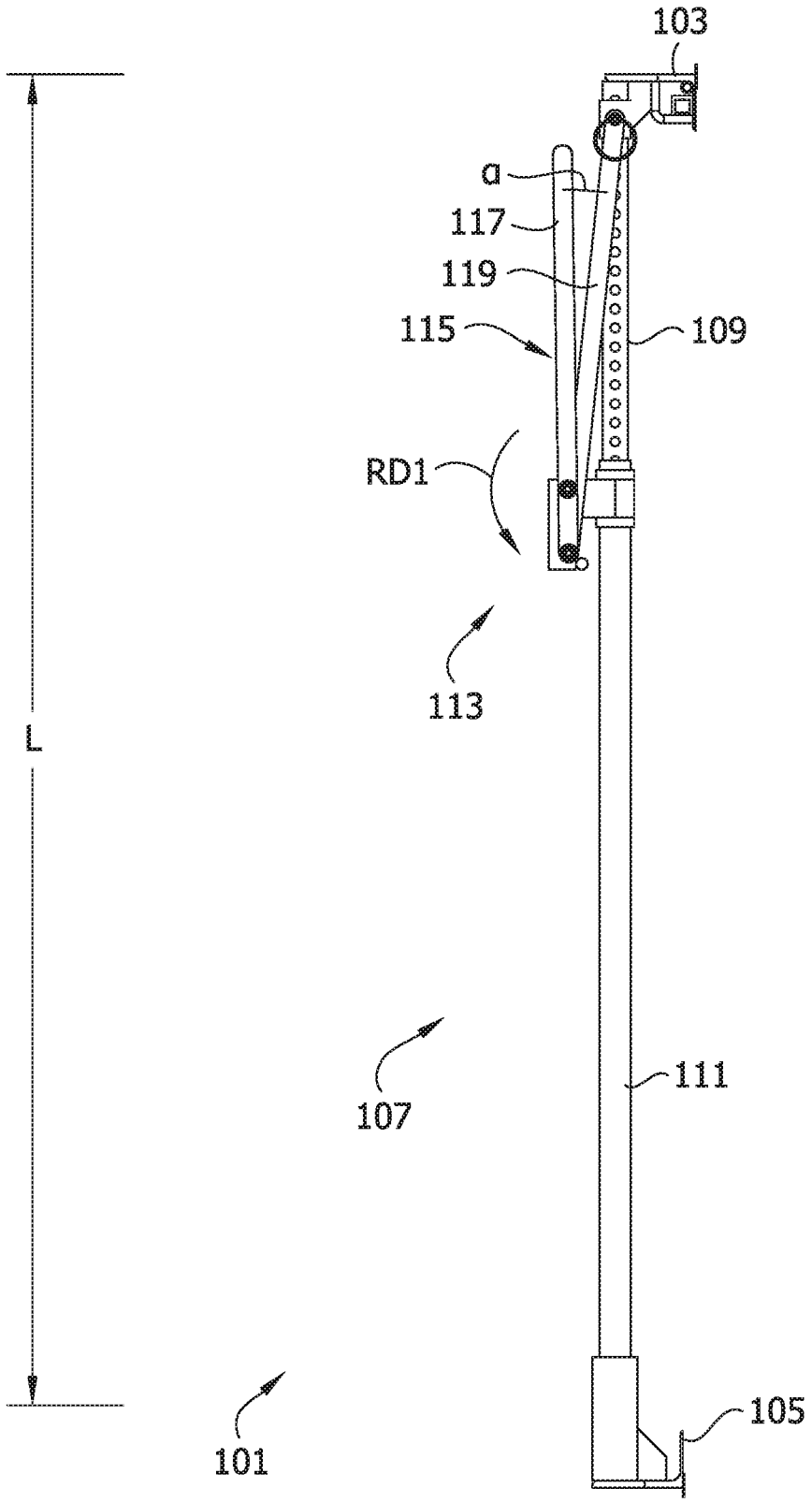
FIGS. 11A-11E are a series of elevations of the jack illustrating various positions of the jack in a range of motion of a press thereof.
Figure 11B:
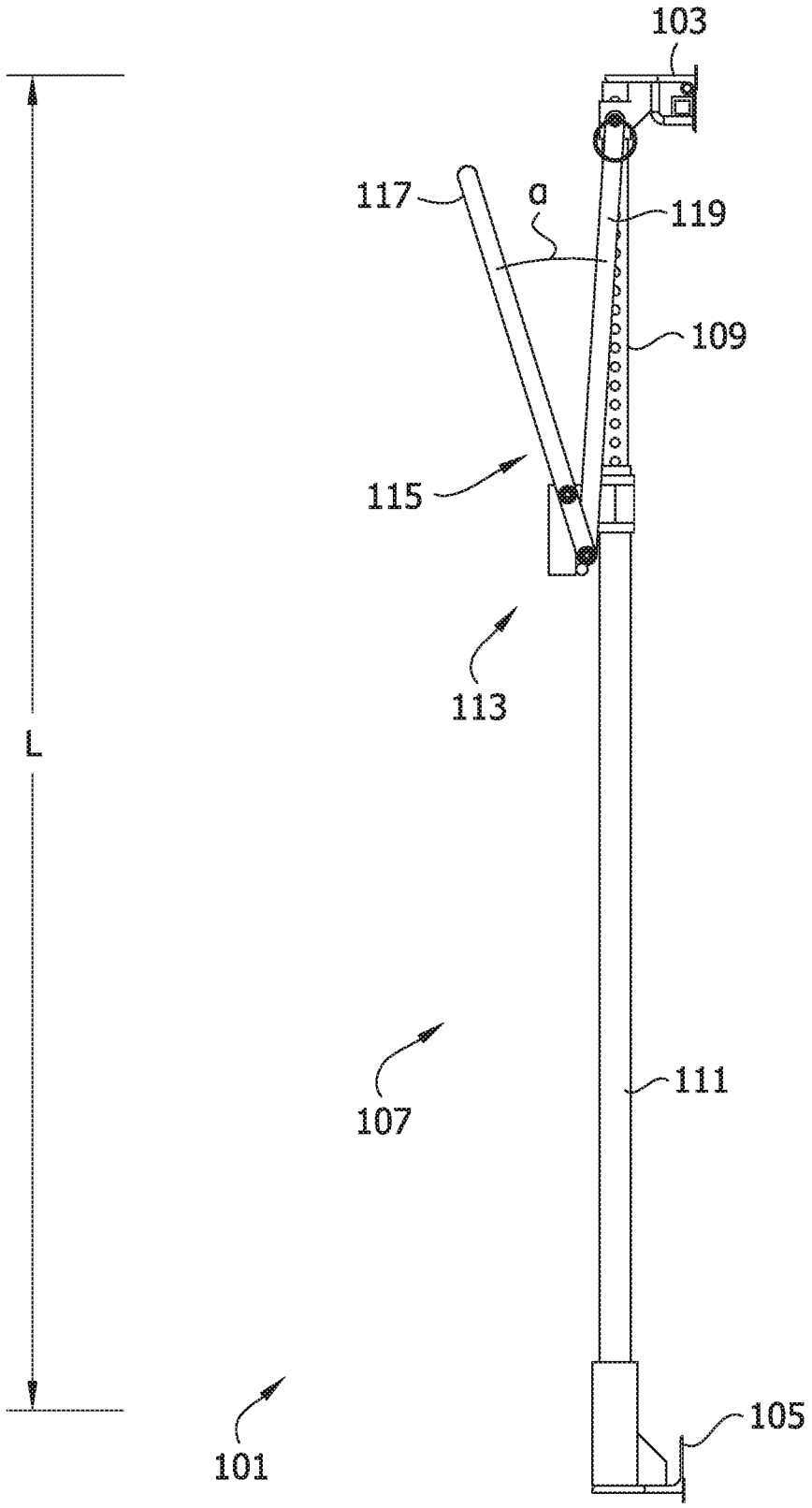
Figure 11C:
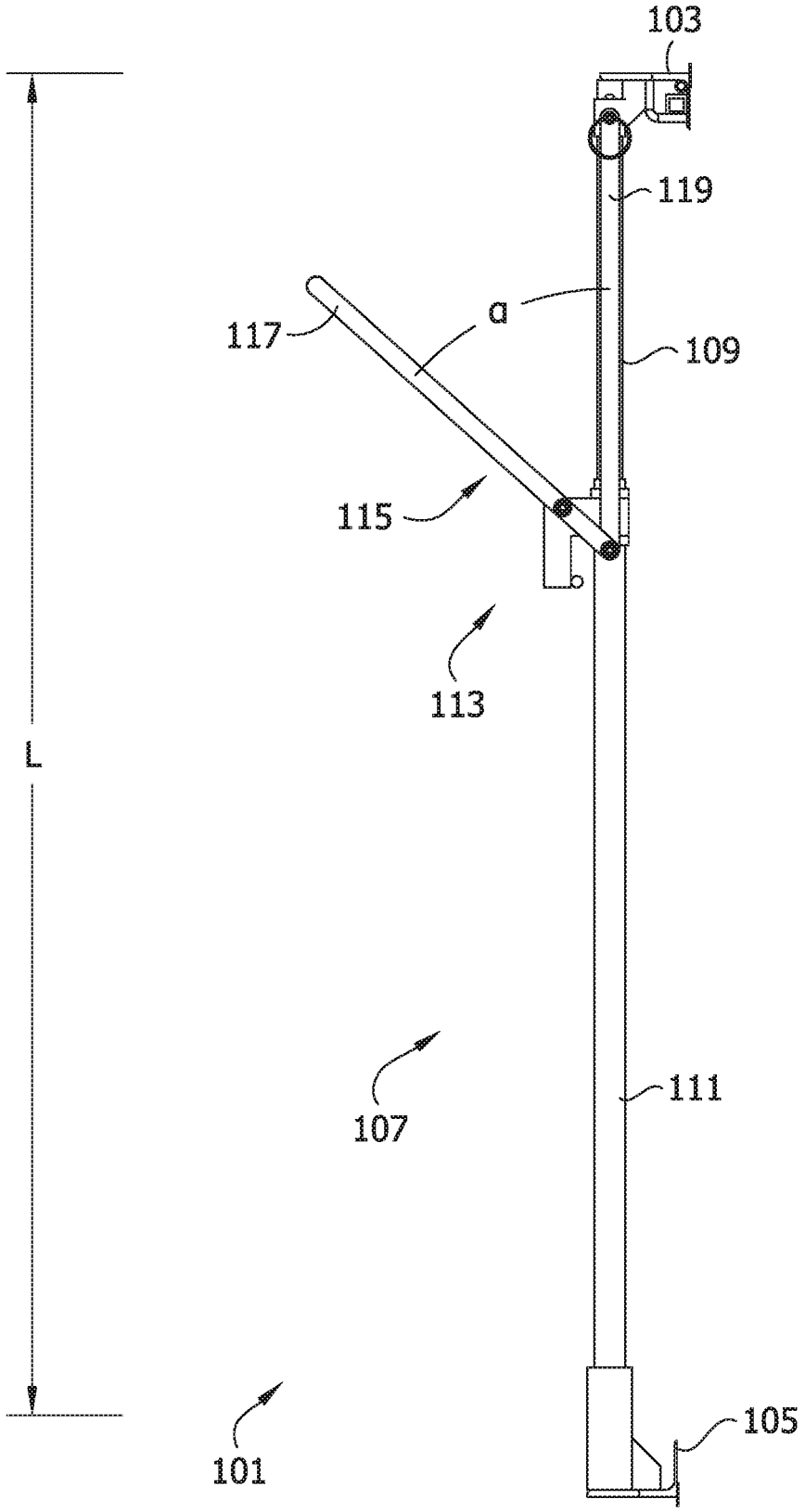
Figure 11D:
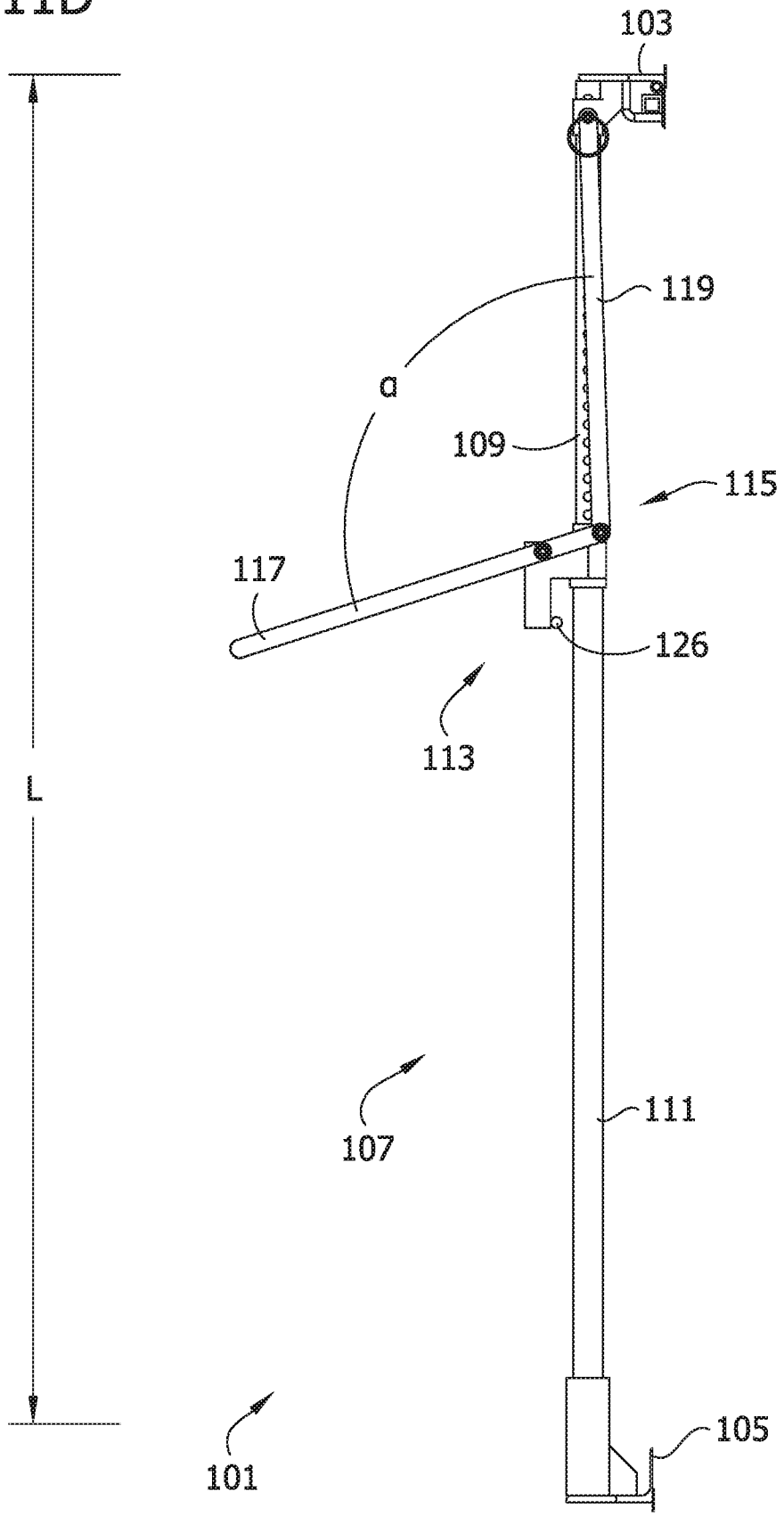
Figure 11E:
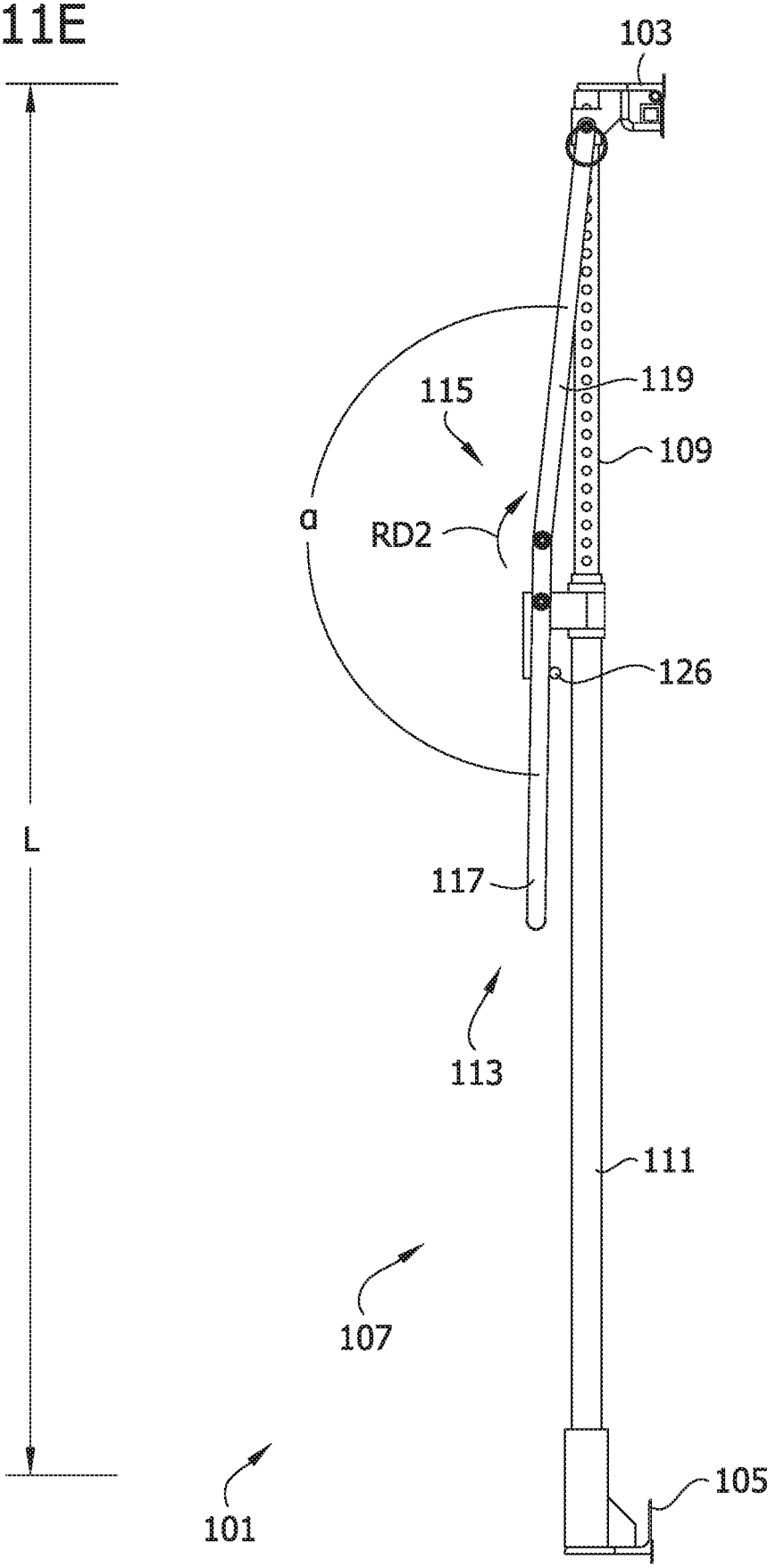

Referring to FIGS. 11A-11E, the lever 117 is movable through a stroke that includes the non-actuated position shown in FIG. 11A and the actuated position shown in FIG. 11E. The lever 117 is rotatable about the lever axis PA1 with respect to the post 107 in a first direction RD1 (e.g., counterclockwise in FIGS. 11A-11E) toward the actuated position and in a second direction RD2 (e.g., clockwise in FIGS. 11A-11E) toward the non-actuated position. In the illustrated embodiment, the handle at the first end portion of the lever 117 moves downward as the lever moves toward the actuated position and upward as the lever moves toward the non-actuated position. The second end portion of the lever 117 moves upward as the lever moves toward the actuated position, which causes the connecting link 119 and upper post segment 109 to move upward relative to the lower post segment 111. The illustrated lever 117 has a limited range of motion about the pivot axis PA1, and in the illustrated embodiment, the actuated and non-actuated positions are at about the ends of this limited range of motion. The stops 126 define the end of the range of motion in the actuated position.

When the upper post connector 131 is locked in a desired position with respect to the upper post segment 109, the press 113 is connected to the post 107 such that movement of the lever 117 toward the actuated position (e.g., in the counterclockwise direction RD1 in FIGS. 11A-11E) moves the upper post segment relative to the lower post segment 111 to extend the length of the extendible post, and movement of the lever toward the non-actuated position (e.g., in the clockwise direction RD2 in FIGS. 11A-11E) moves the upper post segment relative to the lower post segment to retract the length of the extendible post. The illustrated press 113 is thus not configured to extend the post 107 by ratcheting. The press 113 is configured to extend and retract the post 107 along only the extension distance ED (FIG. 7) as the lever 117 moves in the first and second rotational directions RD1, RD2.

As shown in FIGS. 11A-11E, the toggle linkage 115 is configured such that an included angle $\alpha$ between the lever 117 and the connecting link 119 increases as the lever moves toward the actuated position and decreases as the lever moves toward the non-actuated position. In one embodiment, the included angle $\alpha$ can be measured as an angle between a first imaginary line segment extending from the lever axis PA1 to the connecting axis PA3 and a second imaginary line segment extending from the upper axis PA2 to the connecting axis. In the illustrated embodiment, the included angle $\alpha$ is less than 180° in the non-actuated position of the lever 117 and greater than 180° in the actuated position such that the range of motion of the linkage 115 includes a centered position in which the included angle $\alpha$ is about 180°.

The toggle linkage 115 is configured so that the distance between lever axis PA1 and the upper pivot axis PA2 is greatest when the included angle $\alpha$ is 180°. When the upper post connector 131 is locked in the desired position with respect to the upper post segment 109, the pivot axes PA1, PA3 have fixed positions with respect to the lower post segment 111 and the upper post segment, respectively. Thus, when the included angle $\alpha$ is 180° and the distance between the pivot axis PA1, PA2 is greatest, the press 131 extends the post 107 by the maximum amount. As the lever 117 moves in the stroke toward the actuated position, the linkage 115 provides increased leverage and applies increased force extending the stopping panel until the angle $\alpha$ is 180°. In the actuated position, the lever 117 positions the toggle linkage 115 such that the included angle $\alpha$ is slightly greater than 180° so that the post must be extended slightly to rotate the lever away from the actuated position toward the non-actuated position. As will be explained further below, during use of the jack 101, this mechanically inhibits the post 107 from retracting after it is extended until such time as an installer has finished securing the stopping panel 3 in the extended configuration (e.g., by installing suitable ties or brackets on the panel). Accordingly, the illustrated toggle linkage 115 comprises an over-center linkage that has an over-center configuration in the actuated position of the lever 117. Because the toggle linkage 115 passes over the centered position as the lever 117 moves from the non-actuated position to the actuated position, the press 113 is configured to mechanically inhibit movement of the lever away from the actuated position.

Figure 12:
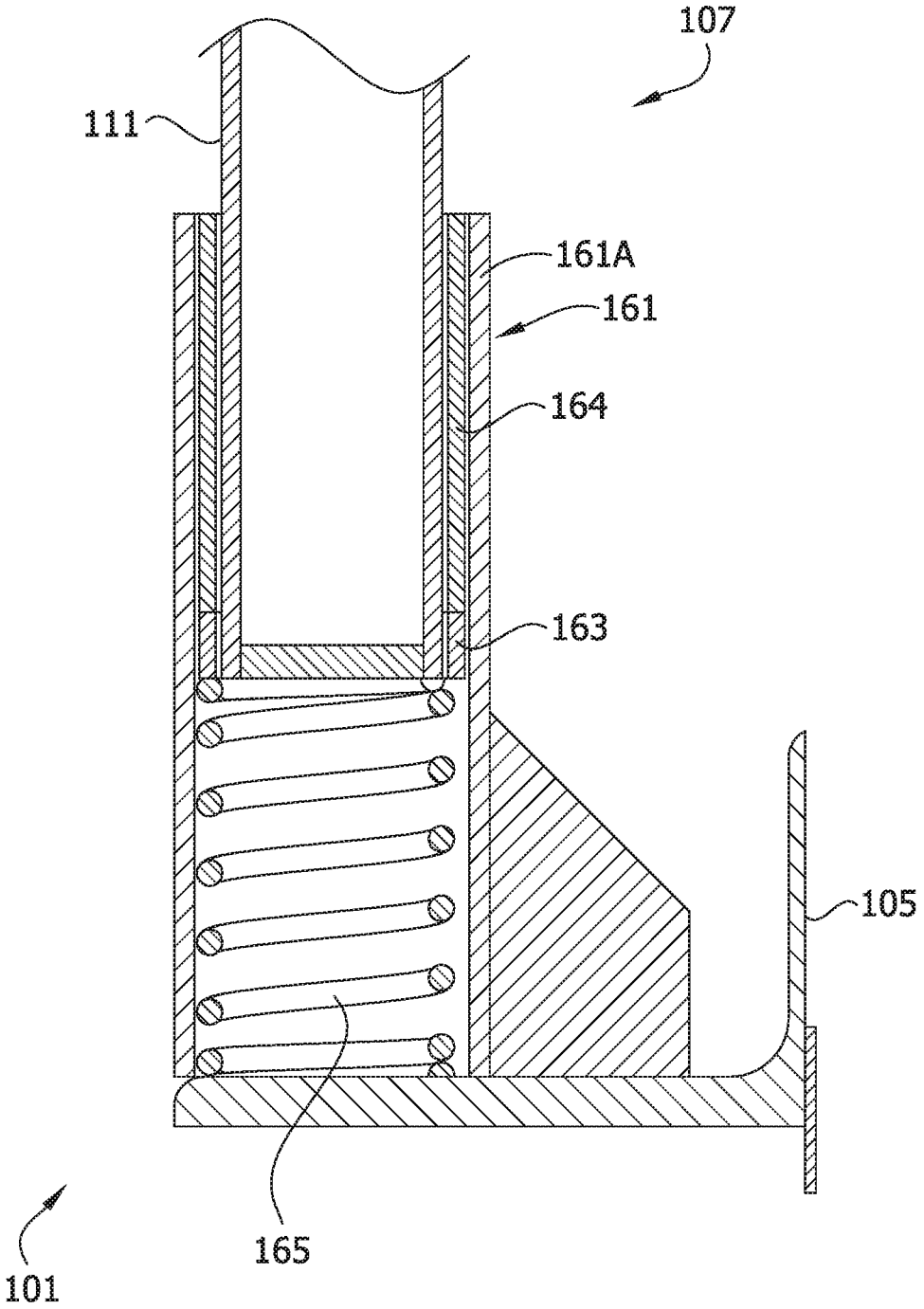
FIG. 12 is an enlarged vertical cross section of a bottom portion of the jack.

Referring to FIG. 12, the jack 101 further comprises a post support 161 that connects the extendible post 107 to the lower stopping panel support 105. The extendible post 107 is connected to the post support 161 for movement with respect to the post support in a direction generally parallel to the length L of the extendible post. In the illustrated embodiment, the post support 161 comprises a tubular body 161A, and the bottom end portion of the lower post segment 111 is slidably received in the tube. In one or more embodiments, lower post segment 111 comprises an annular bearing 163 that slidably engages the post support 161. Suitably, the post support 161 can include a retainer 164, illustrated as a tubular bushing secured to the tubular post support body 161A, to prevent the bearing 163 from sliding out of the top of the post support body.

A compression spring 165 (broadly, a yieldable biaser) is located between the extendible post 107 and the post support 161. In the illustrated embodiment, the spring 165 is received in the interior of the post support body 161A and comprises a bottom end engaged with a bottom of the jack 101 (e.g., a portion of the lower stopping panel support 105) and a top end engaged with the bottom end portion of the post. The spring 165 is configured to yield in response to a compression force that urges the extendible post 107 toward the mine floor F when the press 113 is actuated to press the head 37 of the mine stopping panel 3 against the roof R of the mine. Suitably, the spring 165 is configured to yield when the compression force exceeds the force required to operably crush the seal 39 of the mine stopping panel 3 against the roof R of the mine. Thus, compression of the spring 165 and movement of the extendible post 107 downward in the post support 161 provide an indication that the seal 39 has been crushed to form a resilient and/or elastic anchorage of the stopping panel to the mine roof. Moreover, the spring 165 prevents an excessive crushing force from being applied to the seal 39 because the spring yields and thereby relieves the seal before the crushing force becomes excessive. After the spring 165 is compressed, it imparts a biasing force that biases the post 107 and the upper stopping panel support 103 upward away from the post support 161 and the lower stopping panel support 105. The spring 165 thus biases the upper stopping panel support 103 away from the lower stopping panel support 105 and thereby maintains engagement of the upper stopping panel support with the head 37 of the panel 3 and the lower stopping panel support 105 with the foot 41, and cooperates with the over-center arrangement to maintain the lever in the actuated position, after the press is actuated. It will be appreciated that a user must partially compress the spring to move the lever back over center to move the lever back to the non-actuated position. It is contemplated that, in other embodiments, a jack comprising a yieldable biaser 165, which yields to relieve an excessive crushing force on a stopping seal and/or imparts a biasing force to maintain engagement of a jack with an extended stopping panel, can have another type of press (e.g., a press that extends the jack incrementally with each throw of a lever).

Referring to FIGS. 1-7, to make the mine stopping 1, a plurality of panels 3 are installed in side-by-side relation. In one aspect of the present disclosure, the panels are suitably installed using the jack 101 described above. Initially, the installer positions the panel 3 so that the foot 41 is engaged with the floor. The lower stopping panel support 105 of the jack 101 is engaged with the foot 41 to hold the foot against the floor. With the press lever 117 in the non-actuated position, the installer engages the upper stopping panel support 103 with the head 37 of the panel 3 and withdraws the pins 139 of the upper post connector 131 to disconnect the upper post segment 109 from the press 113. As explained above, the pins 139 and the rings 145 are rotated to the retaining orientations so that the rings temporarily prevent the pins from returning to the locked positions. With the upper post connector 131 unlocked and the upper stopping panel support 103 engaged with the panel head 37, the installer extends the upper post segment 109 with respect to the lower post segment, thereby increasing the non-actuated length L of the post 107 and extending the upper panel member 13 with respect to the lower panel member 11. The installer extends the upper post segment 109 until the seal 39 engages or nearly engages the roof R of the mine.

Subsequently, the installer uses the press 113 to operably crush the seal 39 against the roof R. Before actuating the press, 113 the user rotates the pins 139 and rings 145 of the press connector 131 to the non-retaining orientations to return the pins to the locked positions. The pins 139 extend into a respective pair of openings 133 of the upper post segment 109 to mechanically connect the press to the upper post segment and establish the desired non-actuated length of the post 107. The installer then moves the lever 117 from the non-actuated position to the actuated position. As explained above, the connecting end portion of the lever 117 forces the connecting member 119 and the upper post segment 109 to move upward relative to the lower post segment. The length L of the post 107 is extended by the extension distance ED. Initially, the extension of the post 107 moves the upper panel 13 upward with respect to the lower panel 11 to crush the seal 39. But when the seal is crushed a sufficient amount to create an elastic and/or resilient anchorage of the panel 3 to the mine roof R, the spring 165 yields in compression to prevent further crushing of the seal. As the spring 165 yields, the extendible post 107 moves downward in the post support 161 while maintaining a crushing force on the seal 39.

As the lever 117 is rotated to the actuated position, the included angle $\alpha$ increases to an angle of slightly greater than 180°. Thus, as explained above, after the press 113 is actuated, the post 107 must be extended slightly before it can be retracted. Together, the spring 165 and the seal 29 impart a compressive force on the post that strongly inhibits the lever from inadvertently moving back over center and prevents the post from being inadvertently retracted. Accordingly, after moving the lever 117 to its actuated position, the installer can release the lever. After the lever is released, the over-center mechanism of the toggle linkage 115 maintains the lever in the actuated position and maintains the post 107 in the extended configuration, and the spring 165 urges the post and the upper stopping panel support 103 upward to maintain an operative crushing force on the seal 39. The installer can then secure the panel 3 in the extended configuration using the clamps 7 as disclosed in U.S. Pat. No. 7,438,506 or another type of panel securing system, such as a system disclosed in U.S. Pat. No. 2,729,064, 4,483,642, or 4,695,035.

After the first panel is secured in place, the installer moves the lever 117 from the actuated position to the non-actuated position to retract the post 107 by the extension distance ED and release the upper stopping panel support 103 from the panel head 37. The process is then repeated with a second panel 3. The second panel is installed in side-by-side relation to the first panel. After the second panel is extended using the jack 101, additional clamping devices 7 or another securement mechanism can be used to secure the upper and lower panel members 11, 13 in their extended position and to secure the first and second panels 3 together in the aforesaid side-by-side relation. The above process is repeated for the third and following panels until a wall of panels 3 is formed across the passage, as shown in FIG. 1. Any spaces between the panels and the mine surfaces can be sealed in various ways, such as described in the aforementioned patents.

The resulting wall is strong, lightweight, resistant to leakage, and functions as an integral load-bearing unit capable of resisting larger loads due to pressure differentials across the wall, concussive forces within the mine due to blasting, roof raising or collapse, etc. Nevertheless, in the event of a mine convergence between the roof and floor of the mine passage, the panels 3 will yield in the vertical direction to inhibit damage to the stopping. During this convergence, one of the upper and lower panel members 11, 13 of each telescoping panel will slide relative to the other panel and relative to the clamping device(s) 7.

As can be seen, in one or more embodiments, the jack 101 of the present disclosure is operative to extend a stopping panel 3 and crush the stopping seal 39 by a single throw of the lever 117. The single-throw toggle linkage 115 is very robust and is capable of reliable, repeatable operation in the often harsh environments of a mine. In certain embodiments, after a single downward stroke of the lever 117, the illustrated jack 101 is automatically positioned to securely hold the panel in the extended position, allowing a single installer to extend the jack and immediately begin securing the extended panel 3. Further, in some embodiments, the jack 101 has a built in mechanism (e.g., the spring 165) that prevents over-extension of the panel 3 and excessive crushing of the seal 39.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A jack for installing a mine stopping panel in a mine passageway, the jack comprising:

a first stopping panel support configured to engage a first portion of the mine stopping panel to press the first portion against a first surface of the mine passageway;

a second stopping panel support configured to engage a second portion of the mine stopping panel to move the second portion away from the first portion to press the second portion against a second surface of the mine passageway;

an extendible post having a length and comprising a first post segment connected to the first stopping panel support and second post segment connected to the second stopping panel support, the first post segment being movable relative to the second post segment to adjust the length of the extendible post; and a press configured to move the first post segment relative to the second post segment such that the first stopping panel support moves away from the second stopping panel support to press the first portion of the mine stopping panel against the first surface of the mine passageway, the press including a lever pivotable about a lever axis relative to the extendible post to a non-actuated position and to an actuated position, the press being connected to the first and second post segments such that movement of the lever toward the actuated position moves the first post segment and the first stopping panel support relative to the second post segment and the lever axis to extend the length of the extendible post and such that movement of the lever toward the non-actuated position moves the first post segment and the first stopping panel support relative to the second post segment and the lever axis to retract the length of the extendible post, the lever including a free end portion movable between the non-actuated position and the actuated position, the free end portion of the lever arranged to move toward the second stopping panel support as the lever moves toward the actuated position to move the first stopping panel support relative to the lever axis to extend the length of the extendible post, and the free end portion of the lever arranged to move away from the second stopping panel support as the lever moves toward the non-actuated position to move the first stopping panel support relative to the lever axis to retract the length of the extendible post.

2. The jack as set forth in claim 1, wherein the press is configured to extend the length of the extendible post by an extension distance when the lever moves from the non-actuated position to the actuated position.

3. The jack as set forth in claim 2, wherein the first post segment has a first post segment length and the press is selectively connectable to the first post segment at a plurality of spaced apart connection locations along the first post segment length to adjust the length of the extendible post.

4. The jack as set forth in claim 3, wherein the extension distance of the press is the same when the press is connected to the first post segment at different ones of the plurality of spaced apart connection locations along the first post segment length.

5. The jack as set forth in claim 1, wherein the press is configured to mechanically inhibit movement of the lever away from the actuated position.

6. The jack as set forth in claim 1, wherein the lever is connected to the second post segment for rotation with respect to the second post segment about the lever axis, the press further comprising a connecting link that is connected to the lever for rotation with respect to the lever about a first pivot axis and that is connected to the first post segment for rotation with respect to the first post segment about a second pivot axis.

7. The jack as set forth in claim 6, wherein the press is configured such that an included angle between the lever and the connecting link is less than 180° in the non-actuated position of the lever and equal to or greater than 180° in the actuated position of the lever.

8. The jack as set forth in claim 1, further comprising a post support, the extendible post being connected to the post support for movement with respect to the post support.

9. The jack as set forth in claim 8, further comprising a yieldable biaser configured to yield in response to a compression force that urges the extendible post toward the post support and that has a magnitude that is as great as a magnitude of a minimum installation force required for operably crushing a seal of the mine stopping panel.

10. The jack as set forth in claim 9, wherein the yieldable biaser is configured to impart a biasing force that urges the extendible post away from the post support after the yieldable biaser yields in response to the compression force.

11. A system for installing mine stopping in a mine passageway, the system comprising:

a mine stopping panel configured to be installed in the mine passageway, the mine stopping panel including a seal configured to be operably crushed when subjected to a minimum installation force; and a jack configured to install the mine stopping panel in the mine passageway, the jack including:

a column including a first stopping panel support, a second stopping panel support, an extendible post, and a press, the first stopping panel support being configured to engage a first portion of the mine stopping panel to press the first portion of the mine stopping panel against a first surface of the mine passageway;

the second stopping panel support being configured to move a second portion of the mine stopping panel away from the first portion to press the second portion of the mine stopping panel against a second surface of the mine passageway;

the extendible post having a length and comprising a first post segment connected to the first stopping panel support and a second post segment connected to the second stopping panel support, the first post segment being movable relative to the second post segment to adjust the length of the extendible post;

the press being connected to the first and second post segments and configured to move the first post segment relative to the second post segment such that the first stopping panel support moves away from the second stopping panel support to press the first portion of the mine stopping panel against the first surface of the mine passageway;

the column being configured to yield in response to a compression force on the extendible post resulting from the first stopping panel support pressing the first portion of the mine stopping panel against the first surface of the mine passageway, the compression force having a magnitude that is as great as a magnitude of the minimum installation force required to operably crush the seal of the mine stopping panel, the column being configured to bias the first stopping panel support away from the second stopping panel support after yielding in response to the compression force.

12. The jack as set forth in claim 11, wherein the column comprises a yieldable biaser, the yieldable biaser being configured to yield in response to the compression force on the extendible post, the yieldable biaser being configured to bias the first stopping panel support away from the second stopping panel support after yielding in response to the compression force.

13. The jack as set forth in claim 12, wherein the column includes a post support, the extendible post being connected to the post support for movement with respect to the post support, wherein the yieldable biaser is configured to bias the extendible post away from the post support after the yieldable biaser yields in response to the compression force.

14. The jack as set forth in claim 13, wherein at least one of the extendable post and the post support comprises a tube and the other of the extendable post and the post support is movable into the tube when the yieldable biaser yields.

15. The jack as set forth in claim 14, wherein the post support comprises the tube, and the second post segment is movable into the tube.

16. The jack as set forth in claim 14, wherein said other of the extendable post and the post support is retained in the tube against a biasing force of the yieldable biaser.

17. The jack as set forth in claim 11, wherein the press comprises a connecting linkage including a first link connected to the first post segment and a second link connected to the second post segment, the first and second links being connected to each other for rotation about a pivot axis.

18. A jack for installing a mine stopping panel in a mine passageway, the jack comprising:

a first stopping panel support configured to engage a first portion of the mine stopping panel to press the first portion of the mine stopping panel against a first surface of the mine passageway;

a second stopping panel support configured to press a second portion of the mine stopping panel away from the first portion to press the second portion of the mine stopping panel against a second surface of the mine passageway;

an extendible post having a length and comprising a first post segment connected to the first stopping panel support and second post segment connected to the second stopping panel support, the first post segment being movable relative to the second post segment to adjust the length of the extendible post;

a press comprising a connecting linkage, the connecting linkage including a first link and a second link, the first link configured to be connected to the first post segment for rotation with respect to the first post segment about a first pivot axis, the second link connected to the second post segment for rotation with respect to the second post segment about a second pivot axis, the first link being connected to the second link for rotation with respect to the second link about a connecting pivot axis, the second pivot axis being disposed between the connecting pivot axis and a free end portion of the second link, the connecting linkage being movable through a range of motion from a first configuration to a second configuration, and the press being configured to extend the length of the extendible post as the connecting linkage moves in the range of motion from the first configuration toward the second configuration; and at least one retainer connected to the first link and configured to connect the first link to the first post segment;

wherein the first post segment has a first post segment length and a plurality of retainer receivers spaced from each other along the first post segment length, each retainer receiver configured to receive the retainer to connect the first link and the first post segment.

19. The jack as set forth in claim 18, further comprising a collar defining an opening through which the first post segment extends, the collar slidable on the first post segment, the at least one retainer carried by the collar for movement with the collar with respect to the first post segment.

20. The jack as set forth in claim 18, wherein the at least one retainer comprises a protrusion and the retainer receivers comprise openings configured to receive the protrusion.

21. The jack as set forth in claim 1, wherein the extendable post includes opposite first and second ends and a longitudinal axis extending between the first and second ends, wherein the lever axis is spaced apart from the longitudinal axis.

22. The jack as set forth in claim 19, wherein the at least one retainer is slidable relative to the collar between a locked position and an unlocked position, wherein in the locked position the at least one retainer secures the collar to the first post segment to connect the first link to the first post segment, wherein in the unlocked position the collar is free to slide on the first post segment, the at least one retainer being rotatable relative to the collar between a retaining orientation and a non-retaining orientation, wherein in the retaining orientation the at least one retainer is prevented from moving toward the locked position when the at least one retainer is in the unlocked position, and wherein in the non-retaining orientation that at least one retainer is permitted to move toward the locked position from the unlocked position.

* * * * *